US010036183B2

(12) United States Patent
Favier

(10) Patent No.: US 10,036,183 B2
(45) Date of Patent: Jul. 31, 2018

(54) ASSEMBLY FOR PROTECTING AN ITEM OF MERCHANDISE AGAINST THEFT, WHICH CAN BE ASSEMBLED IN A TEMPORARY MANNER

(75) Inventor: Alain Favier, Nogent sur Marne (FR)

(73) Assignee: EXAQTWORLD, Joinville le Pont (FR)

( * ) Notice: Subject to any disclaimer, the term of this patent is extended or adjusted under 35 U.S.C. 154(b) by 0 days.

(21) Appl. No.: 14/233,538

(22) PCT Filed: Jul. 9, 2012

(86) PCT No.: PCT/FR2012/051618
§ 371 (c)(1),
(2), (4) Date: Mar. 18, 2014

(87) PCT Pub. No.: WO2013/011224
PCT Pub. Date: Jan. 24, 2013

(65) Prior Publication Data

US 2014/0321900 A1 Oct. 30, 2014

(30) Foreign Application Priority Data

Jul. 20, 2011 (FR) ..... 11 02273

(51) Int. Cl.
*E05B 65/00* (2006.01)
*E05B 73/00* (2006.01)

(52) U.S. Cl.
CPC ..... *E05B 73/0064* (2013.01); *E05B 73/00* (2013.01); *E05B 73/0017* (2013.01); *Y10T 403/1674* (2015.01)

(58) Field of Classification Search
CPC ..... Y10T 403/1674; Y10T 70/5004; E05B 73/00; E05B 73/0017; E05B 73/0064; E05B 73/0035; E05B 73/0052; E05B 73/0058

(Continued)

(56) References Cited

U.S. PATENT DOCUMENTS 1,023,688 A * 4/1912 Strba ..... 24/706.9
2,087,372 A * 7/1937 Crawford ..... 66/117

(Continued)

FOREIGN PATENT DOCUMENTS

CN 101668917 3/2010
FR 2 944 307 10/2010

(Continued)

OTHER PUBLICATIONS

International Search Report dated Oct. 29, 2012 in corresponding PCT application.

(Continued)

*Primary Examiner* — Lloyd A Gall
(74) *Attorney, Agent, or Firm* — IPSILON USA, LLP

(57) ABSTRACT

Assembly for protecting a product against theft, includes a first part having a spike intended to pass through the product, and a second part provided in a first zone with an orifice for inserting the spike and locking elements to prevent the spike from being withdrawn after insertion. The second part includes at least one second zone for inserting the spike in a plurality of possible positions, the two parts are assembled with one another and kept in two possible modes of assembly. In a first protection mode, the spike is inserted into the orifice of the second part and the locking elements are activated so that a user cannot separate them without a tool; in a second temporary-assembly mode, the spike is inserted into the second zone and held therein in a temporary-assembly position such that a user can separate the two parts from one another without a tool.

16 Claims, 4 Drawing Sheets

(58) Field of Classification Search
USPC ..... 70/57.1, 59, 60, 276, 386, 413; 24/103, 24/114.4, 114.05, 706.2, 706.3, 706.9, 24/704.1; 340/572.1, 572.8, 572.9
See application file for complete search history.

(56) References Cited

U.S. PATENT DOCUMENTS

| | | | | |
|---|---|---|---|---|
| 2,835,948 | A * | 5/1958 | Blake | 24/108 |
| 3,599,453 | A * | 8/1971 | Bauernfeind | 70/129 |
| 3,698,044 | A * | 10/1972 | Chernow | 24/108 |
| 3,911,534 | A * | 10/1975 | Martens et al. | 70/57.1 |
| 3,945,089 | A * | 3/1976 | Gagnon | 24/705 |
| 4,000,543 | A * | 1/1977 | Paskert | 340/572.8 |
| 5,208,580 | A * | 5/1993 | Crossfield | 340/571 |
| 5,309,740 | A * | 5/1994 | Hansen | 70/57.1 |
| 5,392,620 | A * | 2/1995 | Stoltz et al. | 70/57.1 |
| 5,675,999 | A * | 10/1997 | Carlstrom | 70/18 |
| 6,474,117 | B2 * | 11/2002 | Okuno | 70/57.1 |
| 7,464,569 | B2 * | 12/2008 | Kolton et al. | 70/57.1 |
| RE41,550 | E * | 8/2010 | Huehner | 70/57.1 |
| 8,122,572 | B2 * | 2/2012 | Waddell et al. | 24/110 |
| 8,573,011 | B2 * | 11/2013 | Thoonsen | 70/57.1 |
| 8,590,349 | B2 * | 11/2013 | Skjellerup et al. | 70/57.1 |
| 2004/0172988 | A1 * | 9/2004 | Gorst | 70/57.1 |
| 2005/0050693 | A1 * | 3/2005 | Yang | 24/114.05 |
| 2006/0162133 | A1 * | 7/2006 | Takamura et al. | 24/114.4 |
| 2009/0064734 | A1 * | 3/2009 | Zinner | 70/57.1 |
| 2012/0285206 | A1 | 11/2012 | Favier | |

FOREIGN PATENT DOCUMENTS

| | | |
|---|---|---|
| FR | 2 955 413 | 7/2011 |
| WO | 2007105178 | 9/2007 |
| WO | 2008069643 | 6/2008 |
| WO | 2008093293 | 8/2008 |

OTHER PUBLICATIONS

Preliminary Search Report dated Mar. 13, 2012 in corresponding application.
Chinese Office Action dated May 28, 2015.

* cited by examiner

ASSEMBLY FOR PROTECTING AN ITEM OF MERCHANDISE AGAINST THEFT, WHICH CAN BE ASSEMBLED IN A TEMPORARY MANNER

BACKGROUND OF THE INVENTION

The invention relates to an assembly affording protection against theft, notably shoplifting, of a product that may or may not be packaged.

In order effectively to combat shoplifting and, more particularly, to combat the theft of certain products such as textile products (shirts, pullovers, undergarments, trousers, lingerie, ties, socks, tee-shirts, dresses, coats, hats, shoes, polo shirts, skirts amongst others), shopkeepers in the known way use antitheft tags (also referred to as beep tags, hard tags or "EAS tags"). These antitheft tags trigger an antitheft gate or a surveillance system of RFID type arranged at the access points (entries/exits) of a sales point such as a shop of the supermarket or hypermarket type, a boutique, a specialist shop, a duty free shop, a department store, a museum, a video club, a pharmacy and at the access points of any other shop or entity that sells or displays products for self-service that are likely to be stolen or taken without consent.

These tags are generally made up of two parts:

- a tag body which contains a locking system and an active or passive component that triggers detection gates or antennas commonly installed at the shop access points,
- a pin which passes through the product that is to be protected (for example the fabric of a garment) or the cardboard or plastic of blister packs.

In general, the tags are transported from their place of manufacture to the sales points directly or indirectly in two separate parts: the tag bodies are placed in one container (box, carton or the like) and the pins are in another container.

At the sales points the staff attach the tags to the products that are to be protected by, in each instance, taking a tag body out of one container and a pin out of another container and then assembling these in the locked position on the products.

This operation is tricky and time-consuming, especially if the tags are not all identical and come, for example, in various different colourways. The tab bodies on the one hand, and the pins on the other, have then to be selected with discernment, and this represents a not-insignificant amount of time.

Furthermore, picking up the pins is neither easy nor quick because the staff handling them generally try to avoid injuring themselves on the spikes of the pins.

Sometimes, the tag bodies and the pins come in the same container for delivery and they have to then be sorted while at the same time avoiding injury.

It will also be noted that, when the pins are being handled, they may drop on the floor and when they are on the floor, the upwardly pointing spike represents a danger to people walking around the shop.

Furthermore, when a protected product is processed through the sales desk, the two parts of the antitheft tag are separated from one another after the locking system has been unlocked.

Each part of the tag is then collected in a different tub, then the tags are fitted once again to other products in the way described hereinabove.

This refitting suffers from the same disadvantages as those described.

SUMMARY OF THE INVENTION

The invention seeks to overcome at least one of the abovementioned disadvantages by proposing an assembly for protecting a product against theft, comprising a first part comprising a spike intended to pass through the product or packaging containing the product, and a second part which, on the one hand, is provided in a first zone with an orifice into which to insert the spike and, on the other hand, comprises locking means to prevent the spike from being withdrawn after it has been inserted, characterized in that the two parts are assembled with one another and kept in the assembled position in two possible modes of assembly, in a first mode referred to as the protection mode the spike of the first part is inserted axially into the orifice of the second part along a first axis of insertion and the locking means are activated so that a user cannot separate them without a tool, in a second mode referred to as the temporary-assembly mode, the spike being inserted into at least one second zone distinct from the first zone in a plurality of possible temporary-assembly positions which correspond to the spike being inserted respectively along several axes of insertion parallel to the first axis of insertion, the spike being held in each temporary-assembly position in such a way that a user can separate the two parts from one another without a tool.

By virtue of the second, temporary, mode of assembly (this mode is used for handling the non-locked protecting assembly) the two parts of the protecting assembly (e.g. antitheft tag) are assembled, i.e. fixed or coupled together (in this mode permanently) without being locked.

Thanks to a second zone distinct from the first zone (for example transversely offset from the first zone) and which is capable of accommodating a plurality of temporary-assembly positions (for example positions transversely offset from one another and from the axial position according to the protection mode of assembly) the two parts of the protecting assembly can be easily assembled (fixed or coupled) with one another in the temporary-assembly mode. It will be noted that, in one of the possible temporary-assembly positions (the offset non-locked configuration), the two parts are transversely offset from one another with respect to the axial configuration of the protection mode of assembly for which the spike is inserted into the orifice along the first axis of insertion (transverse offset occurs in a direction perpendicular to the axial direction of insertion along the first axis of insertion).

Temporarily assembling the two parts is furthermore easier to do than if the second part had just one single possible temporary-assembly position.

This ease of assembly affords a time saving to the staff handling the protecting assemblies at points where products to be protected are sold or displayed.

Thus, for example, when processed at a sales desk of a sales point, the two parts of a protecting assembly which are assembled with one another, trapping the product in the protection mode, are unlocked by the cashier. Next, thanks to the second zone of the invention, the two parts are very easily assembled with one another in the temporary-assembly mode.

As a result, this temporary assembly saves time when it comes to fitting a protecting assembly to a product that is to be protected, because the two parts of the assembly are already arranged physically against one another, ready to be separated (without a tool) before being fitted to the product.

In the prior art, the sales point employee has to spend time looking for each part of the protecting assembly in a separate container (with the associated risks of injury from the spikes that this operation involves) and then assembling the two parts in the protection mode (locking activated).

The time saving afforded by the presence of a protecting assembly in a single piece ready to be fitted to a product that is to be protected without having the need to unlock the two parts using a tool is far from negligible for just one installation operation. When the number of installation operations to be carried out over the course of a year is taken into consideration, the time saving is considerable.

Moreover, the risks of injury are considerably reduced.

More generally, the said at least one second zone has dimensions greater than those of the diameter of the orifice and than those of the first zone and also greater than those of the diameter of a single opening to accept the spike in the temporary-assembly mode.

These extended dimensions make it easier to insert the spike in the said at least one second zone, in one of the possible temporary-assembly positions (offset configuration) as compared with there being just one possible temporary-assembly position.

Moreover, once the two parts of the assembly have been temporarily assembled, they occupy a small amount of space compared with the space occupied by each part separately.

This measure is advantageous for transporting and storing the protecting assemblies: two separate containers, one for each of the two parts of the protecting assemblies, are no longer required, just one container will suffice and, for example, the protecting assembly needs just one commercial reference.

The logistics and the commercial circuit (ordering, supply, etc.) are therefore simplified.

The protecting assemblies are also easier to recycle after they have been processed through the sales desk (sorting operations eliminated, etc.), offering a considerable time saving.

In this embodiment, the free end of the spike of the first part is protected at least in part inside the second part in order to reduce the risk of injury. Protecting the free end of the spike at least in part means that the free end is not necessarily surrounded on all sides by a wall.

It will also be noted that by protecting the free end of the spike, this spike is also protected against premature wear. Such wear occurs gradually, gradually flattening the spike with the risk actually of damaging the products, particularly textile products, by causing increasing damage to the fibres.

Thanks to the invention, the longevity of a fine spike is therefore increased, allowing better separation of the fibres without breaking them for longer than was achieved before. Indeed, in the prior art, at the shop, the first parts of the protecting assemblies, provided with spikes, are recycled separately from the second parts: the first parts provided with spikes are thrown loose into a container, which causes the spikes to rub and knock together, leading to premature wear thereof.

According to one possible feature, the said at least one second zone has a structure and/or a geometric arrangement with respect to the first zone containing the orifice which allow the said at least one second zone to be differentiated from the first zone of the orifice.

By structuring and/or geometrically arranging the said at least one second zone appropriately, it becomes easier for the staff who are to handle the protecting assembly to differentiate between the latter zone and the first zone containing the orifice. Thus, this staff can readily identify the said at least one second zone and therefore lose little time looking for a temporary-assembly position.

The said at least one second zone can be structured and/or configured, for example, by adapting the shape and/or dimensions and/or constituent material of this zone so that it can accept a spike in a zone distinct from the first zone of the orifice and in a plurality of possible positions.

According to one possible feature which may or may not be dependent on one of the possible features set out hereinabove, the said at least one second zone may, for example, be structured or configured by the presence of several (preformed) openings into which the spike can be inserted and/or by the presence of a material into which the spike can be inserted and removed at will throughout the material (the presence of the material means that it can thus be considered that there is a plurality and even a multitude of non-preformed openings.)

The said at least one second zone may be arranged geometrically in a region that is more or less remote from the first zone containing the orifice so that the two zones are clearly identical and distinguishable visually.

It is also conceivable both to adapt the structure and the geometric arrangement of the said at least one second zone. This may be of benefit when the second part of the protecting assembly has relatively small dimensions and there is a desire to position the said at least one second zone a short distance away from the first zone. Such an arrangement may be encountered when the said at least one second zone and the first zone are on one and the same face, surface or wall of the second part of the protecting assembly.

According to one possible feature, the second part comprises a first face in which the orifice into which to insert the spike is formed.

It will be noted that the shape of this face is not necessarily planar and notably that it may be domed or concave.

This first face may also have a relief and, for example, the insertion orifice may be set back from or project with respect to the first face as a whole.

According to another possible feature, the said at least one second zone comprises a plurality of openings distinct from the orifice, each opening into a hollow portion of the second part, the spike of the first part being inserted into one of the openings and penetrates the hollow portion which is designed to hold the said spike in the temporary-assembly position in one of the possible positions.

Thus, the plurality of possible positions of insertion is obtained by virtue of the plurality of openings in the said at least one second zone.

This plurality of openings makes it easier for the staff handling the protecting assemblies and who have to temporarily assemble the two parts thereof.

In effect, the task is less tricky than it would be if the same staff had available to them just one temporary-assembly opening to be found on the second part of the protecting assembly in order to position the spike.

According to one possible feature, the spike has a free end which is arranged inside a hollow portion in the second, temporary-assembly, mode, thus completely protecting the free end.

According to one possible feature, each opening and/or the hollow portion into which it opens has dimensions sufficiently close to those of the spike so that the spike is forcibly inserted thereinto and held in the temporary-assembly position in the second mode.

Such a temporary-assembly mode is particularly simple to achieve.

According to one possible feature, the second part comprises an internal wall and, for each opening, an internal member attached to the internal wall and therewith defining a hollow portion to accept the spike.

There are therefore one or more internal members in the second part to define, with the internal wall, several hollow portions.

According to one possible feature, the internal wall is substantially cylindrical and the internal member or members form a ring fitted around the wall. The wall may be locally interrupted for inserting the spike.

It will be noted that the ring may be elastic and the spike is forcibly inserted between the internal wall and the ring.

According to one possible feature, the second part comprises, for each opening, an internal member collaborating with the spike housed in the hollow portion so as to apply to the said spike a mechanical force that tends to prevent it from being withdrawn. One or more internal members are thus provided to collaborate with the spike inserted into each possible opening.

According to this embodiment, the spike may be inserted into the second part with greater ease than it can in the previous embodiment in which the spike is forcibly inserted.

According to one possible feature, the internal member, or each internal member if there are several of them, is secured to a wall of the second part and may, for example, adopt the form of an elastically mounted tab.

The temporary fixing or assembly member or each member is thus manufactured with the second part of the protecting assembly and is not visible from the outside.

According to one possible feature, the said at least one second zone comprises guide means for guiding the spike in each of the openings.

This allows the spike to be guided as it approaches each of the openings and therefore encourages the insertion of this spike into one of these openings.

It will be noted that the guide means may be associated with each opening.

The presence of guide means constitutes an aid to positioning the spike in an opening and therefore to temporarily assembling the two parts of the protecting assembly according to the invention.

It will be noted that the guide means that guide the second part may be arranged on the first face thereof.

According to one possible feature, the guide means adopt the form of one or more concavities at least partially surrounding each opening and communicating therewith.

For example, each opening may be arranged in the bottom of a concavity having a substantially convergent or funnel shape.

Alternatively, all of the plurality of openings may be arranged in the bottom of a single cavity.

Alternatively, the openings may be connected to one another by one or more different concavities.

It will be noted that the concavity or concavities may be formed in the first face of the second part of the protecting assembly according to the invention.

According to another possible feature, the plurality of openings are interconnected by a plurality of grooves.

According to one possible feature, the spike insertion orifice and the plurality of openings are arranged on the first face.

This arrangement allows the temporary assembly to be made particularly simple to perform because in this way there is no appreciable change to the habits adopted by the staff who have to handle the protecting assemblies.

Moreover, when the two parts are temporarily assembled via one of these openings, the two parts are radially offset from one another rather than being centred with one another (as they are in the locked position), and this makes it very easy to recognize the temporary-assembly mode by comparison with the protection mode.

According to one possible feature, the plurality of openings at least partially surround the orifice.

The second zone comprising the plurality of openings is thus distinct from the first zone containing the orifice.

The plurality of openings are, for example, distributed in an annular band or zone surrounding the orifice.

The number of openings is, for example, suited to the dimensions of the protecting assembly, and notably to those of the first face of the second part.

According to one possible feature, the openings and the orifice are formed in the first face at different heights, the height being considered in a dimension perpendicular to the other two dimensions in which the first face mainly extends.

This difference in level or in height between the orifice and the plurality of openings alters the structure of the first face by giving it a specific relief.

This difference in level in height thus constitutes a means that assists with positioning the spike in one of the openings.

It will be noted that, in an alternative form, the openings are not necessarily arranged at the same height relative to the orifice.

According to one possible feature, the openings are set back from the orifice in the heightwise direction.

According to another alternative, the orifice is set back from the openings in the heightwise direction.

Each of these two alternative arrangements allows the said at least one second zone bearing the plurality of openings to be differentiated from the first zone containing the orifice.

It will be noted that by forming the openings and the orifice at different heights it is also possible to provide means of guiding the spike in each of the openings and, for example, guide means associated with each opening.

According to one possible feature, the said at least one second zone comprises a soft and elastic material into which the spike can be inserted at will in a multitude of possible positions where it is held in the temporary-assembly position.

By providing such a material in the said at least one second zone of the second part a zone is thus formed in which the spike of the first part will be inserted in a multitude of possible temporary-assembly positions and from which it will be withdrawn, both entirely at will.

Such a material is, for example, an elastomer such as a rubber.

This material is, for example, injection-moulded to the desired shape and then inserted into the second part of the protecting assembly.

It will be noted that the said at least one second zone thus structured or configured comprises a multitude of possible temporary-assembly positions thanks to a multitude of openings which are not preformed but are formed as and when the spike is introduced into the material.

According to one possible feature, the said at least one second zone comprises at least one hollow portion filled with the soft and elastic material.

The second part thus has at least one hollow portion which is filled with a soft and elastic material which has already been formed, for example by injection moulding, so that it occupies the space available in the hollow portion.

It will be noted that the said at least one second zone may be formed of several hollow portions each filled with a soft elastic material with the dimensions and shape suited to each portion.

According to one possible feature, retaining means hold the soft and elastic material in the said at least one hollow portion.

These means make it possible to prevent the material from re-emerging from the hollow portion or from the housing when the spike of the first part has been driven into it and there is a desire to withdraw it therefrom.

According to one possible feature, the first zone containing the orifice and the said at least one second zone comprising the soft and elastic material are arranged on the first face.

With this arrangement, temporary assembly is particularly simple to achieve because the staff tasked with handling the protecting assemblies do not need to alter their habits significantly.

The presence of such a material on the same face as the one bearing the spike insertion orifice once again allows a clear distinction to be made between the second zone and the first zone and thus makes it easier to position the spike in the temporary-assembly zone.

It will be noted that, in the absence of a visible opening in the second zone, there is no risk of the user confusing the insertion orifice with any openings for temporary assembly.

According to one specific arrangement, the said at least one second zone comprises the soft and elastic material at least partially surrounds the orifice.

In one particular arrangement that is simple to achieve, the said at least one second zone comprises a band of soft and elastic material surrounding the first zone containing the orifice.

The hollow portion or the housing provided in the second part thus has a substantially annular shape surrounding the central part comprising the first zone in which the orifice is located.

It will be noted that, in an alternative form of embodiment, the said at least one second zone comprises several zones each one comprising an annular portion of soft and elastic material, all of these zones at least partially surrounding the first zone containing the orifice.

It will be noted for example that it is possible to make do with one or several annular zones portions arranged around the orifice, some distance therefrom.

According to one possible feature, the said at least one second zone comprises a zone referred to as the openings zone comprising the plurality of openings and at least one zone referred to as the material zone comprising the soft and elastic material.

This embodiment combines both the openings and the soft and elastic material and thus affords a great deal of flexibility in use for achieving a temporary assembly.

According to one possible feature, the openings zone and the said at least one material zone are arranged on the first face with the orifice.

This arrangement once again allows a temporary assembly to be achieved in a simple way without the staff tasked with handling the protecting assemblies having to alter their habits.

The arrangement of the opening zone with respect to the material zone is defined according to the requirements and according to the configuration of the protecting assemblies, notably the second part thereof.

According to one particular arrangement, the said at least one material zone at least partially surrounds the opening zone which, in turn, at least partially surrounds the orifice.

It will be noted that the reverse arrangement may also be envisaged.

It should be noted that the length of the spike which needs to be sharp in the material or through the opening may vary according to the locations of the second part or these openings or these materials are provided.

Thus, it is conceivable to envisage a length of spike penetration through the opening which is greater than the length of penetration into the material and that is needed stably to maintain a position of temporary assembly.

According to another possible embodiment, the second part comprises a second face on which the said at least one second zone is arranged at least in part.

This second face is, for example, an opposite face to the first face.

This second face adopts, for example, a convex shape which may be substantially hemispherical, or may adopt some other shape.

The said at least one second zone may thus be provided on this second face in full or in part.

According to one possible feature, the openings are arranged in full or in part on the second face.

Thus, according to one particular arrangement, the plurality of openings may be distributed between the first face and the second face so as to increase the temporary-assembly options available to the staff handling these protecting assemblies.

According to another possible feature, the said at least one second zone comprising the soft and elastic material is arranged on the second face, in full or in part.

It is thus conceivable to have a zone comprising the soft and elastic material on the second face, or even several zones and, for example, to adopt the same approach with respect to the first face.

In an alternative form, out of the first and second faces, one may comprise both an opening zone and a material zone and the other may comprise only an opening zone or only a material zone.

Alternatively, one face may comprise a material zone while the other face may comprise an openings zone.

It will be noted that the second part may comprise one or more faces or surfaces corresponding to one and/or the other of the first and second faces discussed hereinabove.

According to one feature, in the second temporary-assembly mode, the spike is inserted into the orifice and the protecting assembly comprises a means which temporarily deactivates the locking means.

In this embodiment, for example, the spike insertion orifice is used for temporary assembly, something which proves to be even more practical for the staff tasked with handling the protecting assemblies.

The spike can thus be inserted into the orifice without the two parts becoming locked together and requiring a special tool to separate them. Thus, the staff can, without the risk of error, use any one of the openings and the orifice for temporary assembly.

It is conceivable to use the second temporary assembly mode (orifice and means of temporarily deactivating the locking means) for the first entry into circulation of the assembly before it is first fitted to a product that is to be protected. Once the deactivation means has been removed, the protecting assembly can be handled using the said at least one second zone, and no longer the orifice, for temporary assembly.

According to one possible feature, the second part of the protecting assembly forms a casing.

This casing may adopt various forms and, for example, may have a substantially flat first face and an opposite second face of convex shape.

However, the casing may also be adopt a substantially parallelepipedal shape of small thickness.

It will be noted that, in general, the protecting assembly comprises at least one active or passive member which is able to emit electromagnetic waves towards the outside of the protecting assembly or to receive such waves from an external source.

Thus, the active or passive member or members which are able to collaborate with an external antitheft protection/detection complementary system (for example an antitheft gate) and to trigger an alarm are housed in the casing.

The member borne by the protecting assembly (for example the casing) is, for example, a passive member which receives electromagnetic waves when situated in close proximity to the complementary system.

Such a passive member is, for example, a resonant electric circuit which goes into resonance in the way known per se, under the action of excitation waves emitted at the resonant frequency of the circuit.

According to an alternative form, it will be noted that the active or passive member or members that perform the antitheft protection/detection function may be located in the first part of the protecting assembly rather than in the second part forming the casing.

According to one possible feature, a hollow portion is formed in the casing, at the periphery thereof, and each opening into a hollow portion is made in an exterior face of the said casing. The hollow portion is thus made in the thickness of the casing. Several cutouts are, for example, made in the casing for inserting and accommodating the spike of the first part in each of these cutouts which constitute a hollow portion. Such a cutout is, for example, a groove/slot made at the periphery of the casing, for example, in an edge face of the casing (within the thickness thereof).

These cutouts thus allow the free end of the spike to be housed and therefore not only allow the two parts to be associated with one another temporarily in several possible positions, but also protect the staff from the risk of injury when handling the protecting assemblies.

Another subject of the invention is an assembly for protecting a product against theft, comprising a first part comprising a spike intended to pass through the product or packaging containing the product, and a second part which, on the one hand, is provided in a first zone with an orifice into which to insert the spike and, on the other hand, comprises locking means to prevent the spike from being withdrawn after it has been inserted, characterized in that the two parts are assembled with one another and kept in the assembled position in two possible modes of assembly, in a first mode referred to as the protection mode the spike of the first part is inserted axially into the orifice and the two parts are fixed together in an axial configuration, in a second mode referred to as the temporary-assembly mode, the spike of the first part being inserted axially in at least one second zone distinct from the first zone, in a plurality of possible temporary-assembly positions which each correspond to a configuration of the two parts relative to one another which is transversely offset from the axial configuration.

The features and advantages set out hereinabove also apply to the foregoing description of the invention.

BRIEF DESCRIPTION OF THE DRAWINGS

Other features and advantages will become apparent during the course of the description which follows, given solely by way of nonlimiting example and made with reference to the attached drawings in which.

DESCRIPTION OF PREFERRED EMBODIMENTS

Figure 1A:
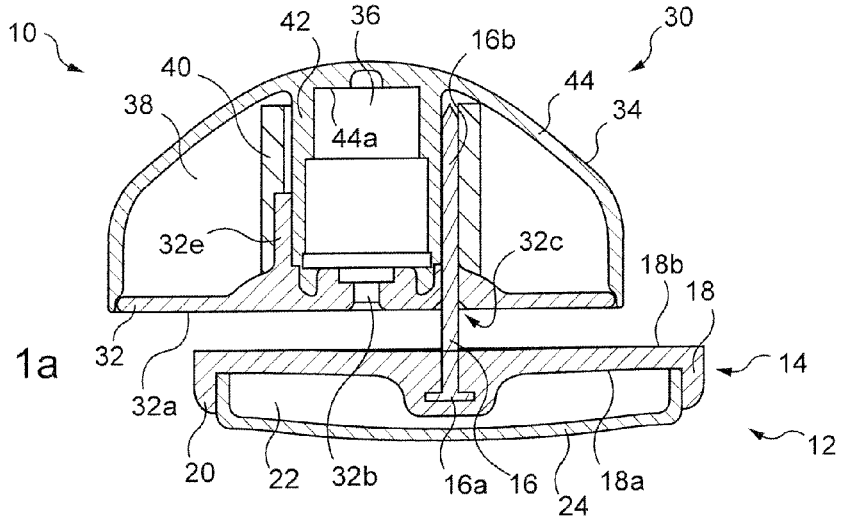
FIG. 1*a* is a schematic view in longitudinal section of a protecting assembly in the temporary-assembly position according to a first embodiment of the invention.

As has been depicted schematically in FIG. 1*a*, an assembly protecting a commercial product (a garment etc.) against theft, and denoted by the general reference 10, comprises a first part 12 comprising a head 14 provided with a spike 16 intended to pass through the product or packaging, for example of the blister pack type, containing the product.

More particularly, the head comprises a first portion 18 in the overall form of a tray in the central part of which is mounted one end 16*a* of the spike which forms the head thereof.

It will be noted that the central part of the tray 18 is thicker than the remaining part thereof so that it can house the head 16*a* of the spike.

The portion forming the tray 18 comprises an annular rim 20 which extends in the direction away from the spike so as to form an internal housing 22 delimited partially by the bottom of the tray 18*a* and partially by the annular rim 20.

It will be noted that the portion forming the tray 18 comprises a face 18*b* on the opposite side to the face 18*a* and from which the body of the spike 16 extends substantially perpendicularly.

A protection interface element 24 (flexible or rigid) closes the housing 22 by resting against the internal face of the annular rim 20.

The housing 22 comprises, for example, a printed wafer visible from outside the head 14 because of the optical properties (for example transparency) of the protection interface element 24 (cap, window, film, etc.).

The protecting assembly also known by the name of antitheft tag also comprises a second part 30 in the overall form of a casing which, in the example depicted in FIG. 1*a*, comprises two portions.

A first portion 32 can be likened to a plate of substantially flat shape having a first face 32*a* in which is formed a central orifice 32*b* that passes through the thickness of the plate for the insertion of the spike 16 in the conventional locked assembly mode. This orifice 32*b* is arranged in a central first zone Z1 depicted in FIG. 2.

The second part 30 also comprises a second portion 34 of convex overall shape which here, for example, takes the form of a dome or a substantially hemispherical shape.

This second portion is hollow overall so that it can house a certain number of elements and in an equatorial plane it has an opening which here is closed off by the plate 32 provided with the spike insertion orifice.

The second portion 34 comprises a central cavity 36 in which are arranged locking means which are intended to prevent the spike 16 from being withdrawn after it has been introduced through the insertion orifice 32*b*.

This central cavity is delimited by an internal wall 42, for example cylindrical, which extends from the internal face 44*a* (bottom) of the wall 44 defining the external envelope of the casing and which is open at its opposite end.

The plate 32 in its central part which faces towards the inside of the second portion 34 comprises a projecting portion 32*e* forming an internal wall which for example is substantially cylindrical.

This wall 32*e* is fitted closely onto the wall 42 and surrounds almost of all of it except at a number of places where the wall 32*e* is locally interrupted to accept the spike 16.

For the sake of clarity, the locking means have not been depicted in FIG. 1*a*.

These are means known per se such as ball-type locking means.

Such means for example comprise several balls placed inside a funnel inside the cavity 36, in one and the same plane and leaving between them a central space to accommodate the spike 16.

When the spike is inserted into the space between the balls, the balls become wedged in the convergent part of the funnel.

Any attempt to withdraw the spike axially has a tendency to wedge the balls more tightly in the convergent part of the funnel and therefore to immobilize the spike.

It will be noted that the balls are made of metal and, more particularly, are made of a magnetic material, which means that they can be extracted from the convergent part of the funnel under the action of an external magnetic field.

The second portion 34 also comprises, at the periphery of the cavity 36, an annular chamber 38 housing a member, or even several members, for example passive, i.e. that are able to receive electromagnetic waves originating from a source external to the protecting assembly 10.

Such a member may for example take the form of a resonant circuit of the LC type.

Alternatively, the casing may contain one or more active members, i.e. members capable of emitting electromagnetic waves from inside the protecting assembly towards the outside.

It will be noted that such active or passive members are, for example, ferrite coils with or without capacitor, LCR circuits, magnetic filaments, circuits of RFID type provided with an active or passive memory chip, etc. This or these members collaborate, via the transmission of electromagnetic waves, with an external detection system such as a gate or an antenna placed at an access point of the shop at which the product or products to be protected are on sale so as to trigger an alarm that the protecting assembly has been detected at the access point.

For the sake of clarity, this or these members has or have not been depicted in FIG. 1*a*.

As this figure depicts, the plate 32 comprises, arranged on its first face 32*a*, an opening 32*c* that passes through the thickness of the plate and is arranged parallel to the insertion orifice 32*b*, distinct and distant therefrom.

This opening is intended for the temporary assembly of the first part 12 with the second part 30.

As depicted in FIG. 1*a*, the spike 16 of the first part 12 is inserted into the opening 32*c* and is engaged inside the annular chamber 38 over most of its length so that the free end 16*b* is positioned inside this hollow portion of the casing.

It will be noted that the opening 32*c* is arranged at one of the points where the hub-forming wall 32*e* is locally interrupted and the dimensions of this recess are tailored to accept the spike between the two interrupted wall portions and the wall 42.

A member internal to the casing is provided inside the latter to apply to the spike 16 a mechanical force that has a tendency to prevent this spike from being withdrawn.

An internal member 40 in the form of an annular ring (or washer) surrounds the forming wall 32*e* and is forcibly fitted around the latter before the plate 32 is installed in position to close the casing in the manner of a cover.

This member 40 is, for example, made of an elastic material such as a rubber. It constitutes an added component which has the advantage of introducing very few modifications when the assembly is being manufactured.

The spike 16 is then inserted into the opening 32*c* (along an axis of insertion parallel to the axis of insertion of the spike into the insertion orifice 32*b*) and is slid to where a zone of the hub has been removed (a slot) between the ring 40 and the wall 42.

The spike 16 is thus forcibly fitted into this hollow portion situated inside the second part 30 and the dimensions of which are sufficiently similar to those of the spike that they prevent excessively easy axial withdrawal.

Figure 1B:
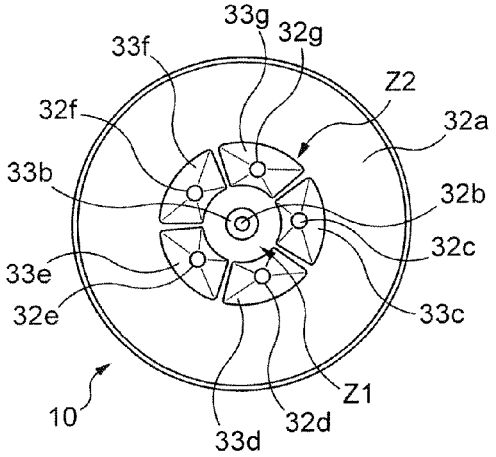
FIG. 1*b* is a frontal view of the first face of the casing.

As depicted in FIG. 1*b* which is a frontal view of the first face 32*a*, several openings (for example five here) 32*c*, 32*d*, 32*e*, 32*f* and 32*g* are provided in the thickness of the plate 32 in a second zone Z2 distinct from the first zone Z1 containing the orifice 32*b*. The openings 32*d-g* are identical to the opening 32*c* and these openings are arranged on the first face at the respective locations where the wall 32*e* is locally interrupted.

The way of inserting the spike 16 and keeping it inside the second part 30 via the openings 32*d-g* (along the axes of insertion that pass via each of the openings and which are parallel to the axis of insertion passing through the insertion orifice 32*b*) is the same as was described in relation to the opening 32*c*.

A concavity or widening 33*b* is formed around the orifice 32*b* to guide the spike into this orifice.

Several concavities or a widening 33*b* is formed around the orifice 32*b* to guide the spike into this orifice.

Several concavities 33*c-g* are formed respectively around the openings 32*c-g* to guide the spike into these openings and thus make it easier to position the spike in one of the possible temporary-assembly positions.

Each concavity has, for example, the form of a convergent shape, such as a dish or a funnel, in the bottom of which the entry to the opening is situated. The walls of the concavity thus guide the spike towards the entry to the corresponding opening.

Because the dimensions of each concavity 33*c-g* are more extensive than those of the concavity 33*b*, the operation of inserting the spike into one of the openings 32*c-g* becomes easier.

It will be noted that the first face and, notably, the second zone Z2 containing the openings, is structured/configured to differentiate this zone from the first zone. The guide means 33*c-g* contribute to this configuration.

Moreover, the openings 32*c-g* are spaced from the orifice 32*b* and recessed into first face 32. Thus, the relief conferred on the first face also assists with differentiating the two zones from one another and therefore with making the spike easier to position in one of the temporary-assembly positions.

In the position depicted in FIG. 1*a* (transversely offset configuration), the two parts 12 and 30 are assembled/fixed temporarily to one another to allow them to be transported and handled in a better way than in the prior art and notably without the risk of one of the two parts becoming mislaid.

Thus, the free end of the spike of the first part is hidden from the outside, avoiding any risk of injury to those handling the assembly and also protecting the free end against premature wear (by knocks, unwanted contact, etc.).

Furthermore, this temporary-assembly mode is particularly practical because the staff handling such a protecting assembly can disassemble the two parts from one another without needing a special tool.

All that is in fact required is for a withdrawal force to be applied to the first part using one hand while holding the second part in the other hand.

It is then enough to place the first part and the second part on a product in the known way so that they can be assembled in the locked position that provides protection against theft.

It will further be noted that the temporary-assembly mode of FIG. 1*a* makes it possible to save space when transporting the protecting assembly and also when storing it.

Incorporating temporary-assembly means in the protecting assembly thus gives the protecting assembly a new functionality because this assembly can thus be handled with the two parts associated with one another but not locked.

Figure 2:
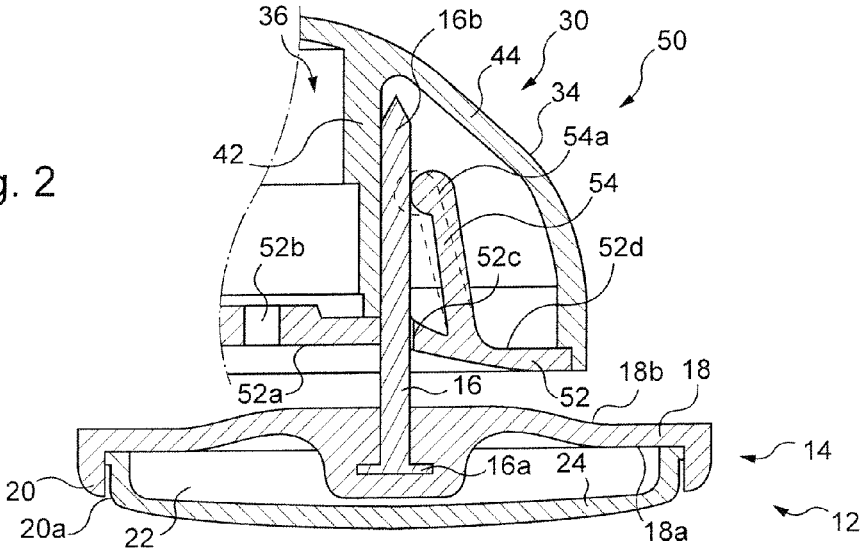
FIG. 2 is a schematic view in longitudinal section of a protecting assembly in a temporary-assembly position according to a second embodiment of the invention.

FIG. 2, which is a partial view with cutaway, illustrates another protecting assembly 50 with the two parts 12 and 30 and another type of member internal to the casing for keeping the spike in the temporary-assembly position.

It will be noted that this internal member is, for example, secured to a wall internal to the casing and takes the form, for example, of a tab, this tab has a degree of elasticity so that it can adopt two positions.

In FIG. 2, the plate 52 forming the casing is pierced with a central orifice 52*b* and with several peripheral openings of which just one, 52*c*, has been depicted. In this alternative form of embodiment, the first face 52*a* is slightly concave in its central part and the orifice 52*b* and the openings are not provided with guide means.

In a first position illustrated in dotted line in FIG. 2, the tab 54 is inclined slightly so that it lies across the path of the spike 16 as it is inserted through the opening 52*c* and progresses into the hollow portion of the casing.

As the in-coming spike encounters the tab 54, it diverts the latter slightly from its first position thanks to its elasticity, so that it occupies a second position depicted in solid line in FIG. 2.

In this second position, the tab applies an elastic return force to the spike 16 and therefore applies a thrusting force that tends to keep it against the internal wall 42 delimiting the central cavity 36, in the slot made in the hub forming internal wall (this wall, not depicted here, corresponds to the wall 32*e* of FIG. 1*a*.)

It will be noted that the tab 54 has at its free end, namely at its end that is not fixed to the plate that forms the support 52, a thicker part forming a protrusion 54*a* intended to come into contact with the spike 16.

This part is thicker than the part that forms the body of the tab so that it is more resistant notably to wear.

It will be noted that, in the example illustrated in FIG. 2, the tab 54 is secured to the internal face 52*d* of the plate 52 which is the opposite face to the first face 52*a*.

However, in an alternative form that has not been depicted, the internal member may be secured to the wall 44 of the casing 30.

Figure 3:
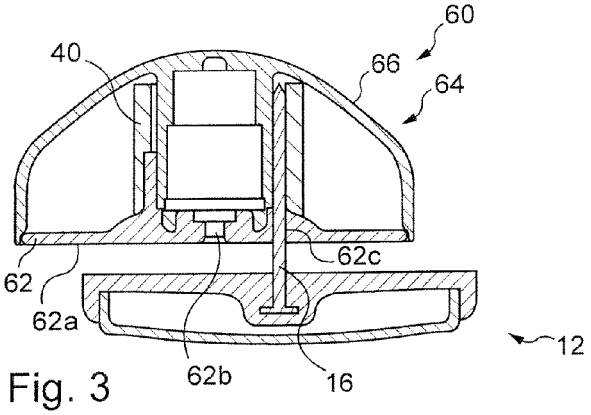
FIGS. 3 and 4 illustrate a protecting assembly in a temporary-assembly position according to a third embodiment of the invention.
Figure 4:
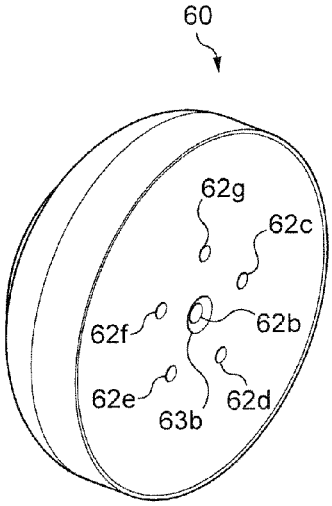

FIGS. 3 and 4 illustrate another embodiment of the protecting assembly according to the invention.

The protecting assembly 60 comprises two parts, namely the first part 12 identical to that of FIG. 1*a* and a second part 64 which is modified slightly by comparison with the second part 30 of FIG. 1*a*.

As in the embodiment of FIG. 1*a*, the second part 64 comprises a first portion 62 constituting a substantially planar closure plate of a second portion 66 that constitutes the hollow body of the casing.

The first face 62*a*, just like the first face 32*a* in FIG. 1*a*, comprises an orifice for the insertion of the spike 62*b* and a plurality of openings 62*c-g* arranged substantially peripherally around the orifice 62*b*.

Thus, once again, the second zone comprising the openings 62*c-g* is distinct from the first zone containing the orifice 62*b*.

Unlike in the embodiment of FIG. 1*a*, the openings 62*c-g* are not equipped with guide means that guide the spike as depicted in FIG. 1*b*.

Only the central orifice 62*b* is provided at its periphery with a guide means 63*b* which here takes the form of a concavity or of a widening from the flat surface of the first face 62*a* towards the opening of the orifice 62*b*.

This arrangement allows the two zones to be differentiated from one another.

It will be noted that the internal member 40 that holds the spike 16 inserted through one of the openings into the casing is identical to the member described with reference to FIG. 1*a*.

However, other arrangements and shapes of internal members are conceivable, such as the one illustrated in FIG. 1*b* for example.

Figure 5:
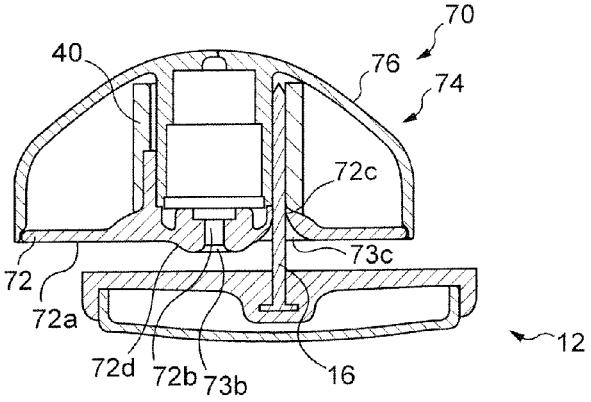
FIG. 5 is a schematic view in longitudinal section of a protecting assembly in a temporary-assembly position according to a fourth embodiment of the invention.

The embodiment illustrated in FIG. 5 depicts an antitheft protecting assembly 70 comprising a first part 12 identical to that of FIG. 1*a* and a second part 74 that is modified slightly by comparison with the second part 30 in FIG. 1*a*.

This second part 74 comprises a first portion 72 constituting a substantially flat plate that closes a second portion 76 constituting the hollow body of the casing.

The plate 72 comprises a first face 72*a* in which there are formed a central orifice for insertion of the spike 72*b* and a plurality of openings of which just one, referenced 72*c*, is depicted in FIG. 5.

Just like the openings in FIG. 1*b*, the openings in this embodiment are arranged peripherally in a second zone surrounding the first zone containing the orifice 72*b*.

In its central part, the plate 72 has an additional thickness such that the first face 72*a* forms a central projection 72*d* around the orifice 72*b*.

A guide means (concavity or widened portion) 73*b* is formed around the orifice at the entry to the latter to make it easier to insert the spike.

The openings such as the opening 72*c* are, for their part, set back from most of the planar surface of the first face 72*a* and notably from the protrusion 72*d*.

Such a structure/arrangement further reinforces the distinction between the second zone containing the openings and the first zone containing the central orifice 72*b*.

It will be noted that each opening is provided with guide means such as the guide means 73*c* around and at the entry to the opening 72*c*.

These guide means are, for example, identical to those illustrated in FIG. 1*b*.

The internal member 40 that holds the spike inside the casing is also identical to the one described in conjunction with the preceding figures.

Figure 7:
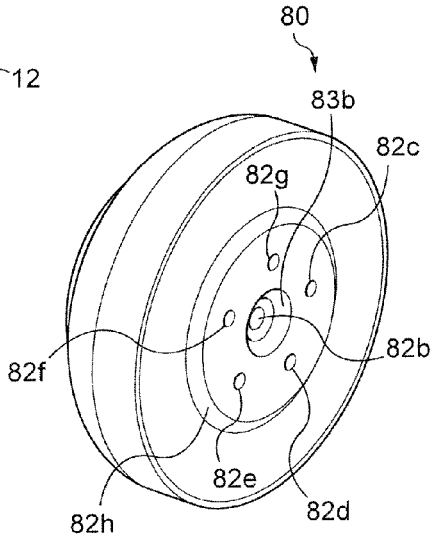
FIGS. 6 and 7 illustrate a protecting assembly in a temporary-assembly position according to fifth embodiment of the invention.
Figure 6:
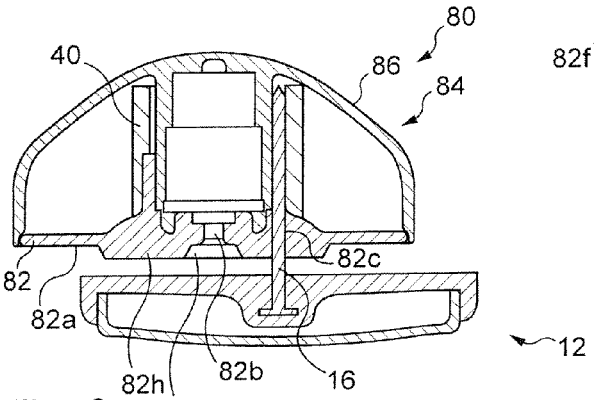

The assembly referenced 80 for protecting a product against theft and illustrated in FIGS. 6 and 7 comprises a first part 12 identical to that of FIG. 5 and a second part 84 which is modified slightly with respect to the second part 74 of FIG. 5.

This second part 84 comprises a first portion 82 constituting a plate closing off a second portion 86 constituting the hollow body of the casing.

The differences between the embodiments of FIGS. 5 and 6 lie in the structure of the plate 82 and notably of its first face 82*a*.

Just like the embodiment of FIG. 5, the embodiment illustrated in FIG. 6 comprises a central insertion orifice 82*b* and a plurality of openings 82*c-g* illustrated in FIG. 7.

None of these openings in this instance is equipped with guide means, for example like those depicted in FIGS. 1*a* and 1*b*.

However, according to an alternative form that has not been depicted, such guide means could be arranged around each opening.

The openings 82*c-g* are arranged in a second zone surrounding the first zone containing the central orifice 82*b*.

In this embodiment, the plate 82 also has an additional thickness in a central part more extensive from that of FIG. 5.

Specifically, the additional thickness of the plate in FIGS. 6 and 7 here allows both the openings and the central orifice 82*b* to be accommodated.

The first face 82*a* is thus planar in its peripheral portion and forms a central projection 82*h* in which the plurality of opening 82*c-g* and the central orifice 82*b* are formed.

It will be noted that guide means are provided around the orifice 82*b* to guide the spike as it is inserted into this orifice.

These guide means 83*b* adopt the form of a concavity surrounding the orifice and which extends from the projecting part 82*h* of the first face as far as the entry to the orifice.

As depicted in FIG. 6, this concavity has the overall shape of an overturned dish.

This structure around the orifice 82*b* thus makes it possible to differentiate the two zones (the one bearing the openings and the one bearing the orifice) from one another.

It will be noted that the structure of the first zone containing the orifice with its guide means 83*b* allows this first zone to be individualized and therefore distinguished from the second zone.

In this embodiment, the orifice 82*b* is recessed from the openings in the heightwise direction of the plate, and in this embodiment the recess distance corresponds to a thickness of the plate.

Figure 8:
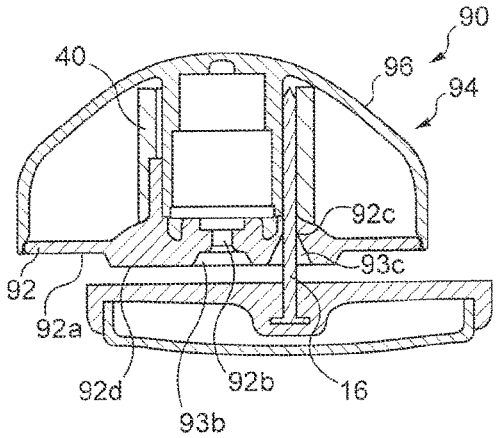
FIG. 8 is a schematic view of a protecting assembly according to an alternative form of embodiment of FIG. 6.

The embodiment of FIG. 8 illustrates an antitheft protecting assembly 90 which differs very little from the embodiment of FIGS. 6 and 7.

The protecting assembly 90 comprises a first part 12 identical to that of FIG. 6 and a slightly modified second part 94.

This second part 94 comprises a first portion 92 constituting a substantially flat plate closing off a second portion 96 constituting the hollow body of the casing.

The plate 92 also has an additional thickness, just like the plate 82 of FIG. 6, in which the central orifice for insertion of the spike 92*b* and a plurality of openings such as the opening 92*c*, are formed.

The first face 92*a* is planar in its peripheral portion and forms a central projection 92*d* in which the orifice and the openings are formed.

The orifice 92*b* and the openings such as the opening 92*c* are also provided with guide means making it easier to guide the spike and therefore insert it either into the orifice or into one of the openings.

The orifice 92*b* is thus equipped with a guide means 93*b* adopting the form of a concavity or of a widened part.

This concavity or widened part has, for example, the overall shape of an upturned dish or of a funnel.

The openings like the opening 92*c* are also each provided with a guide means identical to those illustrated in FIGS. 1*a* and 1*b* and which for example have a convergent, for example funnel-shaped, overall shape.

The opening 92*c* is thus provided at its entry with a convergent guiding shape 93*c*.

In all the embodiments that have just been described, the second zone comprising the openings and the first one comprising the orifice have all been depicted with the same geometric layout but this merely constitutes one exemplary embodiment.

Indeed other geometric arrangements are conceivable.

For example, the openings may be further away from the orifice and, for example, arrange in the peripheral planar portion of the first face in FIGS. 6 and 8.

The number of openings and the way in which they are arranged relative to one another, and likewise the associated guide means, may also differ.

The openings may thus for example be arranged in a staggered configuration relative to one another or in some other geometric arrangement.

The guide means may, for example, adopt the form of one or more concavities connecting two consecutive openings together where the concavities illustrated in FIGS. 1*a* to 8 are independent of one another.

It is, for example, possible to conceive of connecting all the openings together using a concavity in the form of a slot/trough running between two consecutive openings.

Likewise, the shape of the second part constituting the casing of the protecting assembly can be altered to make it thicker at its periphery so that part of the length of the spike can be more readily accommodated.

The casing may also adopt shapes that are not necessarily cylindrical or hemispherical and that are, for example, rectangular or square or some other shape.

Figure 9:
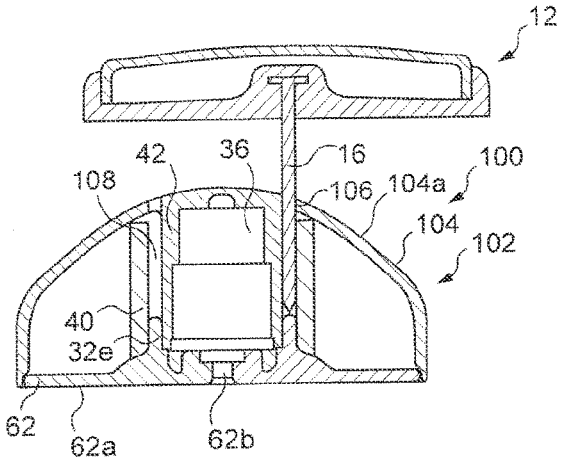
FIG. 9 is a schematic perspective view of a protecting assembly in a temporary-assembly position according to a sixth embodiment of the invention.

FIG. 9 illustrates another form of embodiment in which the second comprising a plurality of openings is no longer arranged on the first face of the second part of the protecting assembly but on another face.

As depicted in FIG. 9, the assembly protecting a product against theft and referenced 100 comprises a first part 12 identical to that of FIG. 1*a* and a second part 102 which differs from the second part 30 of FIG. 1*a*.

This second part 102 comprises a first portion 62 constituting a plate closing a second portion 104 which constitutes the hollow body of the casing.

The orifice for insertion of the spike for assembling the two parts 12 and 102 in the antitheft protection mode is arranged on the first face like the orifice 32*b* of FIG. 1*a*.

The openings of the second zone are, for their part, formed on the second face 104*a* of the second part and which defines the external envelope thereof.

In the illustration of FIG. 9, the external face 104*a* defines an opposite face to the first face 62*a* of the first portion 62.

In this example, two through-openings are formed in the wall of the second portion 104 so that the spike 16 can be inserted temporarily into them.

The openings 106 and 108 are formed as close as possible to the wall 42 surrounding the cavity 36 as radially close as possible to the central part of the body of the casing, where the height of the casing is at its greatest.

This arrangement allows a spike to be housed more easily without making too many modifications to the second part 102.

As depicted in FIG. 9, the openings 106 and 108 are arranged vertically plumb with the hub-forming wall 32*e* so that once the spike has been inserted it is aligned with this wall.

It will be noted that if there is a desire to engage the spike 16 more deeply inside the casing it is possible, as for the embodiment of FIG. 1*a*, to create local interruptions in the hub-forming wall 32*e* so that the free end of the spike penetrates vertically towards the plate 62 at the place where the wall has been interrupted.

It will be noted that a greater number of openings may be arranged on the second face of the second part 102, in the same circumferential layout or in different radial positions.

The number and the layout of the openings is notably dependent on the configuration of the casing and, in particular, on its height in the regions at which the spike is to be inserted.

As the plate 62 situated on the front face is substantially planar, the plate 62 of the convex (for example domed) second part can be placed on a flat surface (a table, etc.) in the position illustrated in FIG. 9 to make it easier to introduce the spike into openings 106, 108 in the wall of the second portion 104.

Moreover, having the spike installed on the rear face of the casing stabilizes the assembly in the containers during transport.

Furthermore, the arrangement of FIG. 9 makes it easy to spot the temporary-assembly mode.

Although it has not been depicted in FIG. 9, one or more openings may be formed in the thickness of the plate 62 plumb with the openings 106 and 108.

The advantage of having two aligned through-openings in the second part of the protecting assembly lies in the fact that the two parts of the assembly can be assembled temporarily with one another using either one of the two aligned openings.

This embodiment is particularly simple to implement during a simple operation.

However, for various reasons it is possible also to provide through-openings in the plate 62 without these aligning with the openings made in the second portion 104 of the casing.

It should be noted that the internal member depicted in FIG. 9 is identical to that depicted in FIG. 1*a* and its operation is itself the same.

However, this internal member may be replaced with another internal member, for example of the kind depicted in FIG. 1*b* (tab), it being possible for this tab to be secured for example to the internal face of the wall 62 or of the wall of the second portion 104.

Of course, in such a case it is appropriate to have as many internal members as there are possible temporary-assembly positions within the casing.

However, according to an alternative form that has not been depicted, it is conceivable to arrange just one internal member of substantially annular shape which will act as a member to hold the spike once it has been inserted in any one of the temporary-assembly positions.

Figure 10:
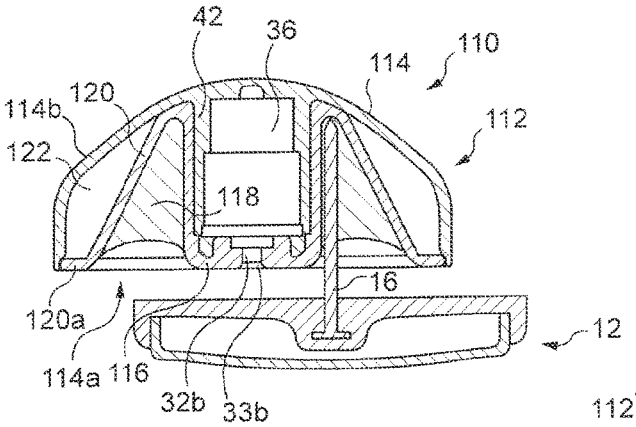
FIGS. 10 and 11 are schematic views of a protecting assembly in a temporary-assembly position according to a seventh embodiment of the invention.
Figure 11:
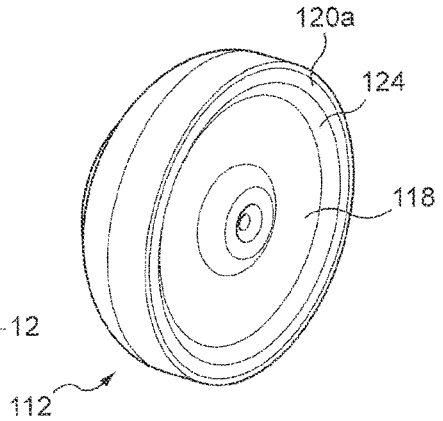

FIGS. 10 and 11 illustrate another embodiment of a protecting assembly according to the invention.

This assembly 110 comprises a first part 12 identical to that which has been described previously and a second part 112 in the overall form of a casing.

This second part 112 comprises a portion 114 forming the body of the casing and which is partially opened on the first face 114*a* thereof where as its opposite second face 114*b* is closed and convex in shape, for example domed like the shape illustrated in the other embodiments.

As in the embodiment of FIG. 1*a*, a central orifice 32*b* for the insertion of the spike for assembling the two parts in protection mode is formed in the front frontal face of the casing 112 in a central plate 116.

This central plate 116 constitutes a first zone comprising the orifice 32*b*.

The second part 112 also comprises a second zone comprising a soft and elastic material 118 into which the spike 16 can be inserted at will in a multitude of possible positions where it can be held in the temporary-assembly position.

Such a material which is elastically deformable can thus accept the spike after the spike has been inserted into the body of the material and this spike can be withdrawn entirely at will at the end of temporary assembly.

Such a material is, for example, an elastomer such as a rubber which can be injection moulded so that it adopts the chosen shape to be housed inside the casing 112 in a space of predefined dimensions and predefined shapes.

In the example illustrated in FIGS. 10 and 11, the second zone comprising the material completely surrounds the first zone containing the central orifice 32*b*.

However, in an alternative form that has not been depicted, the second zone may be divided into several sub-zones each comprising a hollow portion in the casing and which is filled with the soft and elastic material.

The second zone can thus be discontinuous.

The material can thus for example have the consistency of a gum used in papermaking or may even adopt a softer consistency as need be.

As depicted in FIGS. 10 and 11, the second zone comprises a hollow portion formed inside the casing 112 and which is filled with the soft and elastic material.

A wall structure of annular shape or in the form of a trench is arranged inside the casing to form an hollow annular internal space in which the soft and elastic material is placed.

By way of example, this wall structure is formed from a flat wall the central part of which forms the plate 116 when in the first zone surrounding the orifice 32*b* (equipped with a guide means 33*b*) and which then extends laterally, perpendicular to the plate 116, to form two spaces one on either side of the plate and each being substantially in the shape of an inverted V.

Thus, the wall structure has the overall shape of an inverted W in which the central part which would generally be pointed, is flattened here.

This wall structure 120 is set into the second portion 114 of the casing 112, conforming to the shapes of the central part which is surrounded by the substantially cylindrical wall 42.

The wall structure 120 may include an annular rim 120*a* that closes the open front face of the second portion 114 of the casing.

The wall structure 120 thus forms an internal space open to the outside so that it can be filled with the material 118 and an internal space that is closed 122, at the periphery of the casing, in which to house one or more active security members capable of emitting or of receiving electromagnetic waves in collaboration with a security installation such as a security gate generally positioned at the entrance and exit to a sales point.

When the filling material 118 was shaped to the dimensions of the space provided inside the wall structure 120, it is placed in this space as depicted in FIG. 10.

Retaining means visible in FIG. 11 are provided to hold the material 118 in the hollow portion provided for that purpose in the casing.

These means actually allow the material 118 to remain inside the hollow portion when the spike 16 is withdrawn therefrom.

These means adopt the appearance, for example in FIG. 11, of an annular collar 124 arranged around an inside of the peripheral rim 120*a*, extending towards the center of the casing so as to overlap part of the periphery of the material 118.

These retaining means may of course adopt other forms and are not depicted in FIG. 10.

As depicted in FIGS. 10 and 11, the first zone containing the orifice 32*b* and the second zone comprising the material 118 are arranged on one and the same face of the second part 110, namely the first face, referred to as the frontal face, thereof.

Figure 12:
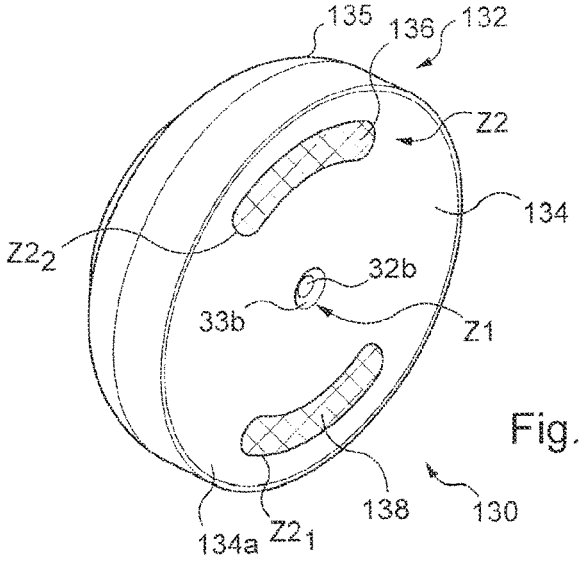
FIG. 12 is a schematic perspective view of part of a protecting assembly according to an eighth embodiment of the invention.

FIG. 12 illustrates another embodiment of a protecting assembly 130 according to the invention.

In this figure, only the casing-forming part 132 of the protecting assembly 130 has been depicted.

The first part fitted with the spike is identical to the first part 12 depicted in the other figures.

As depicted in FIG. 12, the part 132 comprises a plate or wall 134 closing the portion 135 that constitutes the body of the casing.

This plate 134 has a front or frontal face that is substantially planar and in which a spike insertion orifice 32*b* is formed with a guide means 33*b* (in the same way as in the embodiments of FIG. 10).

The orifice 32*b* is formed in a central first zone Z1 and a peripheral second zone Z2 partially surrounding the first zone is provided on the first face 134*a*.

This second zone is arranged sufficiently far away from the first zone but it is possible to differentiate the two zones from one another.

Moreover, this second zone has a structure which, once again, allows it to be differentiated from the first zone.

The second zone is depicted here in the form of two subzones $Z2_1$ (material 138), $Z2_2$ (material 136) each of which for example has the shape of an annular portion.

More specifically, each zone for example has a shape substantially resembling that of a bean.

Each of these zones comprises a soft and elastic material into which the spike 16 of the first part can be inserted at will in a multitude of possible positions where it is held in the temporary-assembly position.

The features and advantages of the material 118 of FIGS. 10 and 11 likewise apply to the embodiments of FIG. 12 and will not be repeated.

It will be noted that a different number of zones comprising a soft and elastic material for the insertion of the spike in the temporary-assembly mode may be envisaged.

For example, one single zone may be formed on the first face 134*a* rather than the two subzones depicted, and the shape of this single zone may adopt one of the shapes of the two subzones or any different shape, for example the shape of an angular sector with its point directed towards the central orifice 32*b*.

A higher number of subzones may also be envisaged, for example four, so as to more or less form an annular hoop even though all of these subzones are discontinuous.

Figure 13:
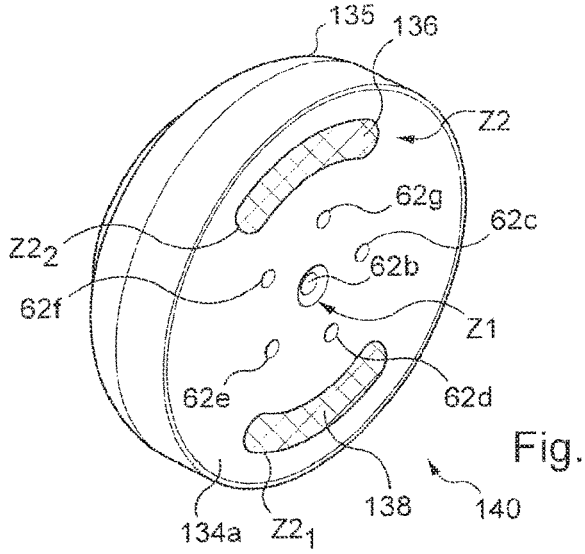
FIG. 13 is a schematic view of part of a protecting assembly according to an alternative form of embodiment of the FIG. 12.

FIG. 13 illustrates an alternative form of embodiment of the protecting assembly of FIG. 12, comprising a second zone Z2 combining an openings zone and two material zones containing a soft and elastic material $Z2_1$ and $Z2_2$.

The subzones $Z2_1$ and $Z2_2$ are identical to those described with reference to FIG. 12.

The openings zone comprising the plurality of opening 62*c-g* is identical to the opening zone illustrated in FIG. 4.

As depicted in FIG. 13, the openings zone and the material zones are arranged on the first face 134*a* with the orifice 62*b* of the first zone.

With this geometric layout, the two material subzones partially surround the openings zone which itself partially surrounds the orifice 62*b*.

In an alternative form that has not been depicted, the arrangement may be reversed in as much as the plurality of openings of the openings zone are arranged at the periphery of the first face 134*a* and the material subzones are closer to the first zone Z1 around the orifice.

In this arrangement, the risk of confusing the openings with the orifice is considerably reduced because these openings are very far away from the orifice.

Of course, by combining the material zones and the openings zone on one and the same face of the casing, the shape, number and position of each of the zones or subzones can to suit the requirement and the specifics of the intended application.

Figure 14:
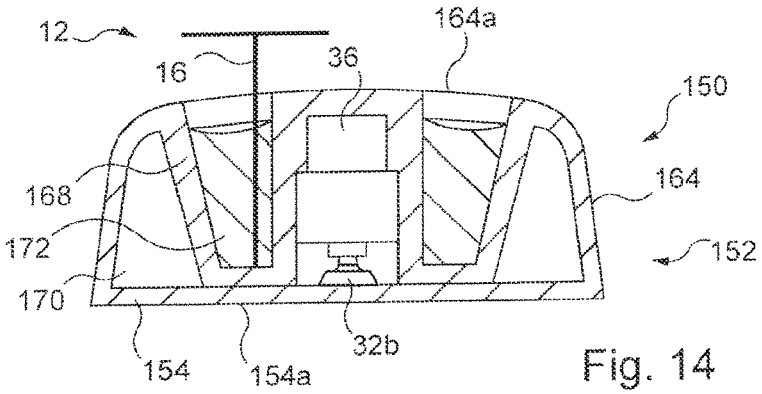
FIG. 14 is a schematic view of a protecting assembly in a temporary-assembly position according to a ninth embodiment of the invention.

FIG. 14 illustrates another embodiment of a protecting assembly 150.

This assembly comprises two parts, a first part 12 identical to that which has been described with reference to the preceding figures and which is provided with a spike 16 and with a second part 152 which for example takes the form of a casing.

This second part 152 comprises a plate 154 of substantially planar shape having a first face 154*a* in which there is formed an orifice 32*b* for the insertion of the spike in the protection mode.

This plate constitutes a plate that closes a portion 164 that forms the hollow body of the casing.

This portion 164 has an exterior face of substantially convex shape which in this instance is referred to as the second face and which is the opposite face to the first face 154*a*.

Viewed in cross section in FIG. 14, the inside of the casing is shaped/configured with a wall structure 168 similar to the wall structure 120 of FIG. 10.

This wall thus adopts, when viewed in cross section, a wavy shape so that it successively creates a closed peripheral space 170 in which to house one or more active or passive detection members and an annular open space in which to house a soft and elastic material used to accept the spike 16 in the temporary-assembly mode, as illustrated very schematically in FIG. 14.

Thus, the second zone comprising the soft and elastic material into which to stab the spike is arranged on the second face 164*a* of the second part of the protecting assembly whereas the first zone containing the orifice for locking is formed on the first face 154*a* of the second part.

It will be noted that other forms of embodiment for housing a material into which to stab the spike on the second face of the casing are conceivable, for example in the manner of the subzones illustrated in FIGS. 12 and 13.

It will also be noted that throughout the foregoing, the spike is generally pushed in with a vertical orientation (perpendicular to the wall closing the casing) but that other orientations are conceivable thus, for example the spike 16 may be arranged parallel to the plate 154 provided that the space left free for introducing the spike into the material 172 is arranged substantially vertically rather than substantially horizontally as in the figure.

These various possible arrangements are quite obviously likely to alter the layout of the other regions and functional parts of the casing and notably of the central region in which the locking means are situated and the peripheral region in which the security member or members is or are located.

Moreover it will be noted that in various alternative forms, the active or passive security member or members may be arranged in the first part of the protecting assembly according to the invention.

The invention claimed is:

1. Assembly for protecting a product against theft, comprising:

a first part comprising a spike intended to pass through the product or packaging containing the product; and a second part with a first zone with an orifice into which to insert the spike, locking means for preventing the spike from being withdrawn from the orifice after the spike has been inserted into the orifice, and at least one second zone distinct from the first zone, wherein the first and second parts are assembled with one another and kept in the assembled position in two possible modes of assembly, in a first mode referred to as the protection mode the spike of the first part is inserted axially into the orifice of the second part along a first axis of insertion and the locking means are activated so that a user cannot separate them without a tool, and in a second mode referred to as the temporary-assembly mode, the spike being inserted into the at least one second zone in a plurality of possible temporary-assembly positions in which the spike may be inserted respectively along several second axes of insertion that are each parallel to the first axis of insertion, the spike being held in each temporary-assembly position in such a way that a user can separate the two parts from one another without the tool, and wherein said at least one second zone comprises a plurality of openings distinct from the orifice, surrounding said orifice, said second zone defining a spike guiding region containing a plurality of substantially contagious concavities, each surrounding a corresponding one of said plurality of openings, and communicating therewith, said concavities forming a substantially complete concave ring around said orifice, each of said concavities being more extensive in size than said orifice, such that any pressing of said spike into any area near said first zone and said spike guiding region results in said spike entering at least one of said concavities instead of said orifice, each opening allowing entry of said spike into a hollow portion of the second part, the spike of the first part being inserted into one of the openings and penetrates the hollow portion, said hollow portion of said second part having a retaining element, where said spike is held in said second part in the temporary-assembly position, in one of the possible positions, via said retaining element.

2. Protecting assembly according to claim 1, wherein said at least one second zone or the first zone containing the orifice has at least one of a structure and a geometric arrangement with respect to the first zone containing the orifice or to the at least one second zone respectively which allow the two zones to be differentiated from one another.

3. Protecting assembly according to claim 1, wherein the second part comprises a first face in which the orifice is formed.

4. Protecting assembly according to claim 3, wherein said at least one second zone is arranged on the first face.

5. Protecting assembly according to claim 3, wherein the orifice and the openings are arranged on the first face.

6. Protecting assembly according to claim 5, wherein the plurality of openings at least partially surround the orifice.

7. Protecting assembly according to claim 5, wherein the openings and the orifice are spaced from each other in a direction perpendicular to the first face.

8. Protecting assembly according to claim 1, further comprising retaining means for holding soft and elastic material in the said hollow portion.

9. Protecting assembly according to claim 8, wherein the soft and elastic material is an elastomer.

10. Protecting assembly according to claim 1, wherein said at least one second zone comprising a soft and elastic material at least partially surrounds the first zone containing the orifice.

11. Protecting assembly according to claim 1, wherein the at least one second zone further comprises a soft and elastic material into which the spike can be inserted at will in a multitude of possible positions where it is held in the temporary-assembly position, and said at least one second zone further comprises a zone referred to as the openings zone comprising the plurality of openings and at least one zone referred to as the material zone comprising the soft and elastic material.

12. Protecting assembly according to claim 11, wherein the second part comprises a first face in which the orifice into which to insert the spike is formed, with the at least one second zone being arranged on the first face, and the openings zone and the material zone is arranged on the first face with the orifice.

13. Protecting assembly according to claim 12, wherein the material zone at least partially surrounds the openings zone of openings which, in turn, at least partially surrounds the orifice.

14. Protecting assembly according to claim 1, wherein said second part includes an internal wall delimiting a cavity in said hollow portion.

15. Protecting assembly according to claim 1, wherein an internal wall and said retaining element are configured to hold said spike in a cavity of said hollow portion.

16. Protecting assembly according to claim 1, wherein said second part is shaped as a plate having said orifice and a substantially hemispherical shape.

* * * * *